US005531507A

United States Patent [19]

Jackson

[11] Patent Number: 5,531,507

[45] Date of Patent: Jul. 2, 1996

[54] METHOD OF REMOVING A MINABLE PRODUCT FROM AN UNDERGROUND SEAM AND BOTTOM HOLE TOOL

[76] Inventor: Daryl L. Jackson, Rte. 2, Box 112, Spiro, Okla. 74959

[21] Appl. No.: 438,186

[22] Filed: May 9, 1995

[51] Int. Cl.[6] ..... E21C 37/12; E21B 43/29

[52] U.S. Cl. ..... 299/13; 37/321; 299/18; 299/68; 166/372

[58] Field of Search ..... 299/4, 10, 13, 299/17, 18, 68; 166/271, 372; 37/317, 320, 321, 322, 323, 324, 326, 331

[56] References Cited

U.S. PATENT DOCUMENTS

| | | | |
|---|---|---|---|
| 842,364 | 1/1907 | White | 37/321 |
| 3,050,289 | 8/1962 | Gerner | 299/5 |
| 4,092,045 | 5/1978 | Sullivan | 299/17 |
| 4,226,475 | 10/1980 | Frosch et al. | 299/13 |
| 4,252,200 | 2/1981 | Peterson | 175/20 |
| 4,330,155 | 5/1982 | Richardson et al. | 299/11 |
| 4,348,058 | 9/1982 | Coakley et al. | 299/17 |
| 4,396,075 | 8/1983 | Wood et al. | 175/79 |
| 4,411,474 | 10/1983 | Higgins | 299/4 |
| 4,421,182 | 12/1983 | Moody et al. | 175/65 |
| 4,433,739 | 2/1984 | Sarin | 175/420.1 |
| 4,449,593 | 5/1984 | Jageler et al. | 175/58 |
| 4,451,088 | 5/1984 | Wisseroth | 299/11 |
| 4,629,011 | 12/1986 | Reinhardt | 175/58 |
| 4,804,050 | 2/1989 | Kerfoot | 175/20 |
| 5,139,312 | 8/1992 | Jackson | 299/13 |

*Primary Examiner*—David J. Bagnell
*Attorney, Agent, or Firm*—Head Johnson & Kachigian

[57] ABSTRACT

An improved method and equipment of removing a minable product, such as coal, from an underground seam of minable product, such as a coal seam, includes the steps of drilling a vertical hole from the earth's surface through the seam of minable product, installing in the recovery hole an improved recoverable down hole tool, having a vertical auger and a hollow shaft extending from the earth's surface to the auger in the down hole tool, water pumped down the hollow shaft exiting through nozzles mounted from below the auger segments in the down hole tool and spaced vertically along the length of the hollow shaft to the earth's surface through the seam of minable product, the injection holes being drilled in a pattern extending from the recovery hole inserting and sequentially igniting explosives in the injection holes, injecting water sequentially in the injection holes and removing the fractured minable product by operating the down hole tool and water nozzles in the recovery hole and raising said minable product to the earth surface.

6 Claims, 7 Drawing Sheets

METHOD OF REMOVING A MINABLE PRODUCT FROM AN UNDERGROUND SEAM AND BOTTOM HOLE TOOL

SUMMARY OF THE INVENTION

This invention relates to a method of removing minable products, such as coal, from an underground seam, and more particularly improvements in said method and tools used with said method.

The mining method of this disclosure is classified by hydraulic engineers as a "closed flow hydraulic system." The method employs the principles of mechanical and fluid dynamics in a closed conduit system under pressure and vacuum. The original invention is described in U.S. Pat. No. 5,139,312 granted to the inventor. The present invention describes a method that improves upon the prior invention and utilized less costly tools in recovery of minable ore, thus enhancing cost efficiency.

As described in the referenced patent the mining process begins after having selected a proven geologic prospect worthy of mining such as a coal seam. The prospect should be such as to have a thick coal seam (18 inches or more) that uniformly slopes from 1° to 90° degrees. There should be a readily available water supply such as deep wells, lakes or large ponds, water filled old open strip pits or underground mines, rivers or permanent streams. The on-site location requires a minimum of surface disturbance usually a few acres. There is no requirement for settlement ponds or for disposal of waste fluids or slurry.

The first step is the drilling of a 22 inch borehole on the down dip end of the coal seam. The method herein discussed assumes the hole to be about 100 feet deep, however, this method may be applicable to much greater depths. The coal seam discussed herein is assumed to range from 28 to 36 inches thick but, once again, this range is only assumed for convenience. Other 22 inch drill holes will be spaced approximately 660 to 1320 feet apart in a line paralleling the strike of the underlying coal seam. These large diameter boreholes are used for recovery of coal and slurry fluids at the surface from underground coal beds, and are termed "recovery holes."

A series of secondary 6 inch boreholes are termed "injection holes." The number of injection holes used in a mining unit with one recovery, hole will depend on the geology, coal type, coal dip and thickness, mining depth, equipment size and other site specific factors.

The equipment inserted into the recovery borehole includes a tubular collared and jointed shaft and a downhole recovery tool. The downhole recovery tool consists of a bottom hole auger device that is placed into the coal seam, extending about 12 inches below the coal seam and 36 inches above the top of the coal seam. This bottom hole tool has a window cut the length of the coal bed thickness through which the coal seam is exposed to the inside auger tool. At the surface of the recovery hole is placed a discharge head tool providing a connection from the pipe in the hole to a dredge pump and a rotary power source on the surface. Between these two tools are placed a column of necessary lengths of tubular collared and joined hollow shaft for a closed pipe system with inside auguring capabilities.

The recovery hole is first drilled about 20 feet deep into bedrock with a 22 inch bit. The twenty foot deep hole is then cemented to the bottom with 20 inch casing. The hole is then drilled deeper through the surface casing with a seventeen and one-half (17½) inch bit to the coal and one foot below the coal seam. Next the bottom hole tool, with the top portion being reduced to 12 inches, is lowered to the bottom of the hole by welding end-to-end longer joints of 12 inch (inside diameter) casing to make up a casing column.

The downhole tool with auger device has a hollow tubular shaft to which are attached additional sections of tubular shafts all the way to the top of the hole.

Water under pressure is pumped down the tubular shaft to exit out the water nozzles spaced vertically and radially outward along the shaft including the downhole tool. The rotation of the downhole tool auger, the pressurized water nozzles pointed upward and the dredge pump on the surface all work to lift the coal slurry up and out of the recovery hole.

The initial stage of the drilling operation begins with four boreholes drilled in close proximity to the large diameter recovery hole, which was previously located and staked for drilling. The procedure of drilling commences with three 6 inch diameter injection boreholes, each spaced five feet apart from the recovery borehole. The 6 inch holes are drilled in a straight line updip and perpendicular to the strike of the underlying coal seam. Each hole is drilled to the bottom of the coal bed. The drilling and completion of the first two 6 inch boreholes are the same except only one is done at a time. The first borehole is drilled through the coal bed and surface casing is set. Underwater explosives are placed only into the coal seam with an electrical detonating cap and wire lead to the surface at the top of the coal bed. Above the explosives in a hole is placed an inflatable five foot elongated balloon type hole plug. It may become necessary in some hole situations to add 3 feet of limestone stemming atop the explosives and then put the balloon plug in place. This balloon is attached to a small air hose extending to the surface where it can be inflated or deflated and retrieved when desirable. If the injection hole is wet and filled up to some static water level then the air balloon plug is inflated at that point rather than at the top of the explosives. This plugging device will temporarily seal the hole, thereby preventing any explosive energy from being directed up the drill hole during the detonation of the previously set explosive material in the coal seam.

Prior to detonation of any of the explosives, the large diameter recovery hole is drilled through the coal seam and cleaned of all material by the drilling rig. Prior to detonation of the explosives in the hole nearest to the large recovery hole, the drilling bit is raised a few feet above the coal level, but remains in the recovery hole. The nearest 6 inch hole is then detonated. Since the path of least resistance is toward the only void in the coal, the recovery hole, the blasted material will be forced to this void. Subsequent to the blast, the drilling bit is re-lowered to the coal seam level and, any blasted material is then removed by the drilling rig and the hole is recleaned.

The second 6 inch injection borehole is then prepared like the first injection hole. Again, the recovery hole drilling rig bit is raised and the second hole is blasted. The recovery hole is recleaned subsequent to the blast. A third 6 inch injection hole is prepared and blasted in the same manner as the first two injection holes, and the recovery hole is again cleaned by the drilling rig. Casing is then set and cemented into the recovery hole. Bottom hole and surface equipment are set into place for hydraulic mining operations.

The auguring operation is then started and water is pumped down the first 6 inch open hole. The pumped water forces the exploded coal down the coal seam to the recovery hole auger tool window. After a void is created from the first hole to the recovery hole, the second injection hole is pumped with water. The void area in the coal seam extends about 10 feet updip. The third injection hole is likewise water pressured from the surface, forcing the blasted chunks of coal to the recovery hole. With the rotation of the auger, under pumped fluids, coal is lifted to the surface from a long channel in the coal seam.

The recovery hole is equipped with a pipe down the center axis of the hole all of the way down to the bottom hole tool. Water is forced down the hole which is forced out the nozzles spaced radially and vertically along the central pipe, and including the bottom hole tool. As the pipe rotates, it rotates the special auger device in the bottom hole tool and it also rotates the water nozzles. The water nozzles are pointed upward so as to inject water under pressure up the recovery hole, which is intended to push the coal up the recovery hole from the coal seam. Located radially outward from the nozzles are roller bearings which roll along the inside of the casing as the central pipe is rotated. The roller bearings aid in preventing the nozzles from impeding the rotation of the pipe and the auger in the bottom hole tool, and also aid in maintaining the pipe along the center axis of the recovery hole.

The operation is then temporarily delayed until both injection holes #1 and #2 are fitted with 2 inch strands of pipe to the coal seam, where a sweep-jet nozzle is installed. These nozzles are short and vertically adjustable to accommodate the dip angle of the coal seam. The nozzle jet can be horizontally rotated from the surface. The pipe and nozzles are permanently lowered into the hole and into the void area in the coal seam. The pipe is sealed at the top of the surface casing with a screw cap with bearing for a water line. The water line pipe can be rotated through the bearing. The nozzle can be rotated toward the recovery hole. The two injection holes are each connected to a surface water pump. The third injection hole is hooked up to a third surface pump after removal of the inflatable balloon plug. It pumps fluids down the open hole, floating the blasted coal chunks toward the recovery hole. It may be possible to pump fluids down every second or third hole rather than down every blasted hole. This depends upon the effect of the blast concussion and the effective radius of the explosives, and the slope or down dip of the seam.

The first and second injection holes are under continuous fluid flowage from the surface pumps. These pumps maintain a high water pressure to the nozzles to further pulverize the chunks of coal at the recovery hole and in the immediately mined area. These two injection holes also provide the necessary volume of water slurry to maintain the void area flow of slurry to the recovery hole.

The recovery hole is also under continuous fluid flowage from a surface pump. The pump maintains a high water pressure to the nozzles which push the coal slurry out of the bottom hole tool up the recovery hole and out at the surface.

After the first stage of the set-up operation, the second stage of the operation is begun. This stage consists of drilling injection boreholes, loading them with explosives ready to be detonated in sequence for continuous operations. The 4th, 5th and all holes drilled thereafter, are drilled perpendicular to the coal strike and updip both in a straight line and radiating from the recovery hole. These holes are also drilled to the bottom of the coal seam, loaded with underwater explosives in the same manner as the first, second and third injection holes. These holes each contain a retrievable, inflatable five foot air balloon plugging device for plugging the hole at any ground water level in the hole. Explosives are then detonated by use of a cap and wire to the surface connected to an electrically controlled detonating device. If the holes are dry, it may be necessary to add a few feet of crushed limestone aggregates as stemming on top of the coal before setting the balloon plug. The need for the limestone stemming depends on the hardness of the strata on top and underlying the coal seam.

The pumped fluids will direct the blasted coal material into the previously created void in the coal seam and will force the coal toward the recovery hole. Since bituminous coals are usually compact, brittle, banded and have a lameliar, conchoidal, splintery fractures and have more or less well defined prismatic jointing, they usually will disintegrate upon forces of explosives and high fluid pressure into cubical or prismatic blocks along their cleavage and joint planes.

After the initial three injection holes are completed and the coal has been removed from them via the recovery hole, there will exist a 15 to 20 foot long channel in the coal bed, updip from the recovery hole. The next succession of injection holes will be blasted and mining will continue either updip, thereby creating a longer channel until the shallowest coal is reached, estimated some 600 feet from the recovery hole, or radial injection holes will be blasted and the coal adjacent to the initial channel opening will be recovered thereby creating a wider coal seam void. This latter method of recovery will both extend the channel updip and, at the same time, will expand out in a fan shape from the recovery hole.

The coal from the detonated and pressured injection holes is forced to follow the path of least resistance, which is toward the bottom of the recovery hole where the coal enters the bottom hole tool through the window of the tool. The tool is designed to crush the coal into smaller sizes as the auger rotates. The coal, due to its specific gravity, will free flow in the heavy medium slurry, up through the recovery assisted by the pressurized water nozzle pipe to the surface. The nozzle lift the fluid flow and prevents any blockage in the pipe. In the upper portion of the recovery hole pipe the dredge pump with its suction pulls the free flowing coal and material slurry from the hole through the discharge head tool, then forces the slurry onto the shaker and washing plant in a volume ratio of about 60% coal to 40% slurry fluids.

Each injection hole is temporarily plugged following its detonation and coal removed. This is accomplished by use of an inflatable rubber device that will be placed in the hole between the surface and the top of the coal level, depending upon water levels in the hole, or just above the level where the coal seam was prior to coal removal in a dry hole situation. The device is then inflated and will remain in place until the hole is permanently sealed. This device will prevent underground fluids from exiting to the surface.

When all hydraulic mining is completed in a set of injection holes with each large recovery hole, the plugging of these holes is conducted by first removing the bottom hole auger tool and the pipe stem in the large recovery hole. The 12 inch casing in the recovery hole may also be removed. The recovery hole is filled with sand and gravel to within a few feet of the surface. If the casing is not removed then, the top three feet of casing is cut below ground level and the void is filled with cement. The 6 inch injection holes are then loaded with explosives at 10 to 20 feet above the original coal level. The exact level is determined by calculation dependent on the overburden material and coal seam void thickness. Upon detonation of the explosives in these holes, the blasted material collapses into the mining void below.

The blasted material provides enough swell to completely fill the mine void and the blasted area with material, and prevents sagging of the overburden material at the ground surface. After blasting all boreholes, the air balloon type plugging devices and surface casing of each hole are removed and each hole is backfilled and cemented to within 2 feet of the surface.

There is essentially no slurry water or waste water for disposal at the conclusion of a hydraulic mining set. There is a continual loss of slurry water in the operation due to its replacing the coal which is removed from underground. This water will be required to fill all voids left by coal removal in order to maintain a pressured system during mining operations. The slurry which is removed with the recovery of coal is recycled and goes through the washing plant and into a settling tank. It is then pumped back into the underground mine area. The same water may make several trips from the underground mine area to the surface, but will ultimately remain below ground to fill the void left by coal removal.

The auger tool used in this mining method consists of two separate devices used in conjunction with connecting pipe that is inserted into a vertical drill hole. This system provides an enclosed pipe passage from an underground coal bed to the surface. The device at the: surface is termed a "discharge head tool". The device installed underground and positioned through the coal bed interval is called the "bottom hole tool". The bottom hole tool is typically the same 12 inch diameter cylinder as the casing pipe in the recovery hole that is constructed of ½ inch steel pipe. The length of the bottom hole tool cylinder varies by the thickness of the coal to be hydraulically mined. By way of example, assuming a specific coal seam thickness of 42 inches a window of this length is to be cut into the cylinder. This window is constructed by removal of up to ½ of the circumference wall. The window is placed in the coal between the top and bottom of the coal seam and exposes the inner-workings of the cylinder to the insitu coal. The window serves as a passage into the bottom hole tool cylinder for chunks of coal and water slurry which are under hydraulic pressure during operation of the device. In viewing the bottom hole tool in a vertical position, the window is cut into the middle and lower portions of the cylinder length.

A one inch thick and 3 inch wide steel reinforcing strap is welded to the vertical outside edge of the window on the bottom hole tool. This reinforcement strap extends a few inches beyond the tool base for anchorage of the tool into the substrata. With this reinforcement strap affixed to the outside diameter of the bottom hole tool, it will typically have a total outside diameter of 14 inches.

The bottom hole tool used in this mining method consists of a special augering device where the auger is not a continuous bar spiraling around the central shaft, but is rather made up of segments with openings in between. In this manner the auger segments wind around the central shaft for only 180° and appear to be on top of each other when viewed from above or along the vertical axis of the auger. Upon rotation of the shaft, this auger arrangement leaves a gap which allow the segmented auger blades to pass above and below a tooth like wedge mounted on a vertical bar called a "crushing bar". The crushing bar with spaced wedges is welded on the opposite side of the window on the inside of the bottom-hole tool. The crushing bar breaks up large chunks of coal in conjunction with the action of the auger and pushes the coal up the backside of the bottom-hole tool to the surface by the first lifting action of the bottom water nozzle.

At the bottom of the open window area and below the bottom auger blade's rotation path is installed a deflection plate. The deflection plate is a baffle welded to the inside of the casing. It is a circular steel plate angling downward from the window opening. The baffle is notched out to allow for rotation of the central shaft, through which pressurized water is pumped down to exit through the nozzles. The bottom water nozzle is located below the baffle plate and the baffle plate acts further to prevent the pressurized water from the lowest nozzle to be forced out into the coal seam through the window area.

Also below the window section and the bottom end of the cylinder is a pipe section that houses a bearing and bottom end assembly for holding the lower end of the auguring device. There is a special segment at the top of the bottom hole tool adjusting the outside diameter from 20 to 12 inches in diameter so additional sections of 12 inch pipe casing can be joined to the bottom hole tool for connection of it to the surface discharge head tool.

The top of the auger is connected by a shaft to a rotary power source.

The bottom hole tool auger is a segmented steel auger. It is constructed from segments of augers by positioning one segment above the other and each are welded onto a common hollow steel shaft. The two auger segments are serrated with notches. These notches are preferably reinforced along the sides with hard alloyed welding material. The serrated rim of the auger, when rotated, crushes the inflowing solid coal and slurry material that has reached the auger through the window. The crushed material is then lifted to the surface by pressure flow assisted by the rotating auger segments and the pressurized water from the nozzles.

The discharge head tool includes a discharge elbow pipe device which is placed at the surface of the hole through which the coal and slurry material is pushed by water pressure and assisted by the rotating auger segments. The discharge head tool is secured to the toll of the recovery pipe in the hole and is constructed of 90 degree L-shaped pipe with a steel constructed rectangle box welded onto the outside of the "L" bend of the pipe. The elbow pipe and box typically have ½ inch thick walls with a 5 inch hole cut out of the center of the box top and through the convex bend of the pipe, when the discharge head tool device is connected to the pipe in the hole, the 5 inch hole will be positioned in the center of the12 inch pipe base for inserting the auger shaft up through the steel box. The auger shaft end will then be connected to a rotary power source.

At the top of the steel box is a bearing and seal cage to prevent leakage of gases when handling vacuum pressured fluids. The discharge head tool ensures a closed fluid flowing system. The discharge head tool is adapted with rotary motion components from outside to auger inside. The smaller 8 inch diameter end of the tool is attached to a dredge pump. The rotary power unit for operating the auger is a hydraulic motor with a gear box connected to the; 5 inch auger shaft.

The improvements of this invention over the prior method provide for a recoverable bottom hole tool, a smaller auguring device present only within the bottom hole tool as opposed to an auger the full length of the recovery hole and the modification of the bottom hole tool auger such that it consists of auger segments, a crushing bar, a baffle and a bottom hole water nozzle each intended to improve the recovery of the coal slurry and reduce cost of the mining operation described.

Dimensions given in this summary are by way of example only and are illustrative of typical sizes of structures for practicing the methods of this disclosure.

For reference to other methods and apparatus for removing a minable product from an underground seam reference may be had to the following U.S. Pat. Nos. 4,396,075; 4,252,200; 4,421,182; 4,804,050; 4,433,739; 4,629,011; 4,348,058; 4,449,593; 4,411,474; and 4,330,155.

A better understanding of the invention will be obtained from the following description of the preferred embodiments taken in conjunction with the attached drawings.

DESCRIPTION OF THE PREFERRED EMBODIMENT

Figure 1:
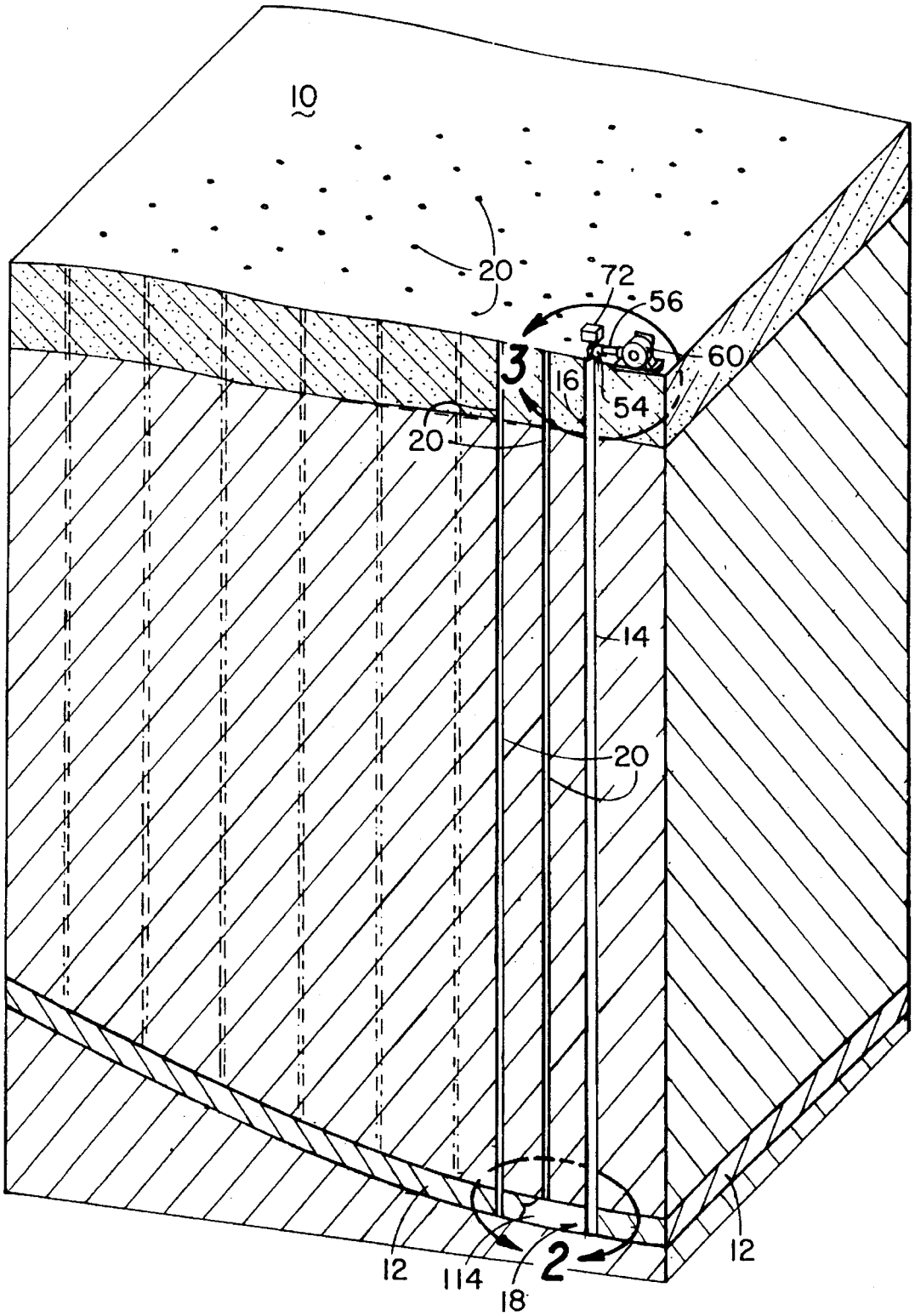
FIG. 1 is an isometric view showing a cross-section of a section of the earth from the surface to slightly below an underground seam of minable materials, such as a seam of coal, and showing some of the basic equipment utilized in the method of this invention.

Referring to the drawings and first to FIG. 1, a cross-sectional section of a surface area of the earth is illustrated, the earth's surface being indicated by the numeral 10 and an underground seam of minable products being indicated by the numeral 12. While this invention can be practiced to recover various mining products, it is particularly applicable for mining coal. The invention will be described as it pertains to mining coal, it being understood that instead of coal other minable products can be recovered by the method of this invention. However, the invention is particularly useful for coal because the specific gravity of coal makes it easy to move by flowing water, whereas recovery of mainable products of greater density would be much more difficult when attempted to be recovered by the principles of this disclosure.

The objective is to move to the earth's surface coal from seam 12 without following the usual mining processes, that is, without removing the overburden and then recovering coal that is usually termed "strip mining process", or without conducting underground passageways wherein miners operate. Instead, the method of this invention is to provide means for recovering coal from seam 12 wherein the surface of the earth is hardly disturbed and wherein it is not necessary for any miner to go below the earth's surface.

The first step in practicing the method of this invention is to drill a relatively large diameter substantially vertical borehole, which is termed a "recovery hole" indicated by the numeral 14. The recovery hole 14 extends from the earth's surface 10 to slightly below coal seam 12. The recovery hole is preferably formed utilizing a relatively large diameter surface pipe 16, such as a pipe of about 20 inches in diameter, for a relatively short distance, such as about 20 feet. The surface pipe is cased or cemented in the borehole.

Thereafter, a somewhat smaller diameter borehole extends from the surface pipe to slightly below the bottom of seam 12. A casing, which may typically be 12 inches in diameter, extends within the surface casing through the seam.

The basic principle of this invention is to fragment coal in coal seam 12 by explosives and to move the fragmented coal from the seam to a bottom hole tool 18 positioned at the lower end of recovery hole 14 by which the fragmented coal is removed. In order to fragment the coal within coal seam 12, a plurality of injection holes 20 are drilled in spaced apart relationship and in a pattern with respect to recovery hole 14. Each of the injection holes 20 is drilled from the earth's surface 10 and into coal seam 12. Explosives are then positioned in the coal seam through the injection holes and the explosives ignited to fragment the coal, after which water is inserted through the injection holes 20 to move the fragmented coal to bottom hole tool 18. All of these steps and the apparatuses used in practicing the steps will now be described.

Figure 2:
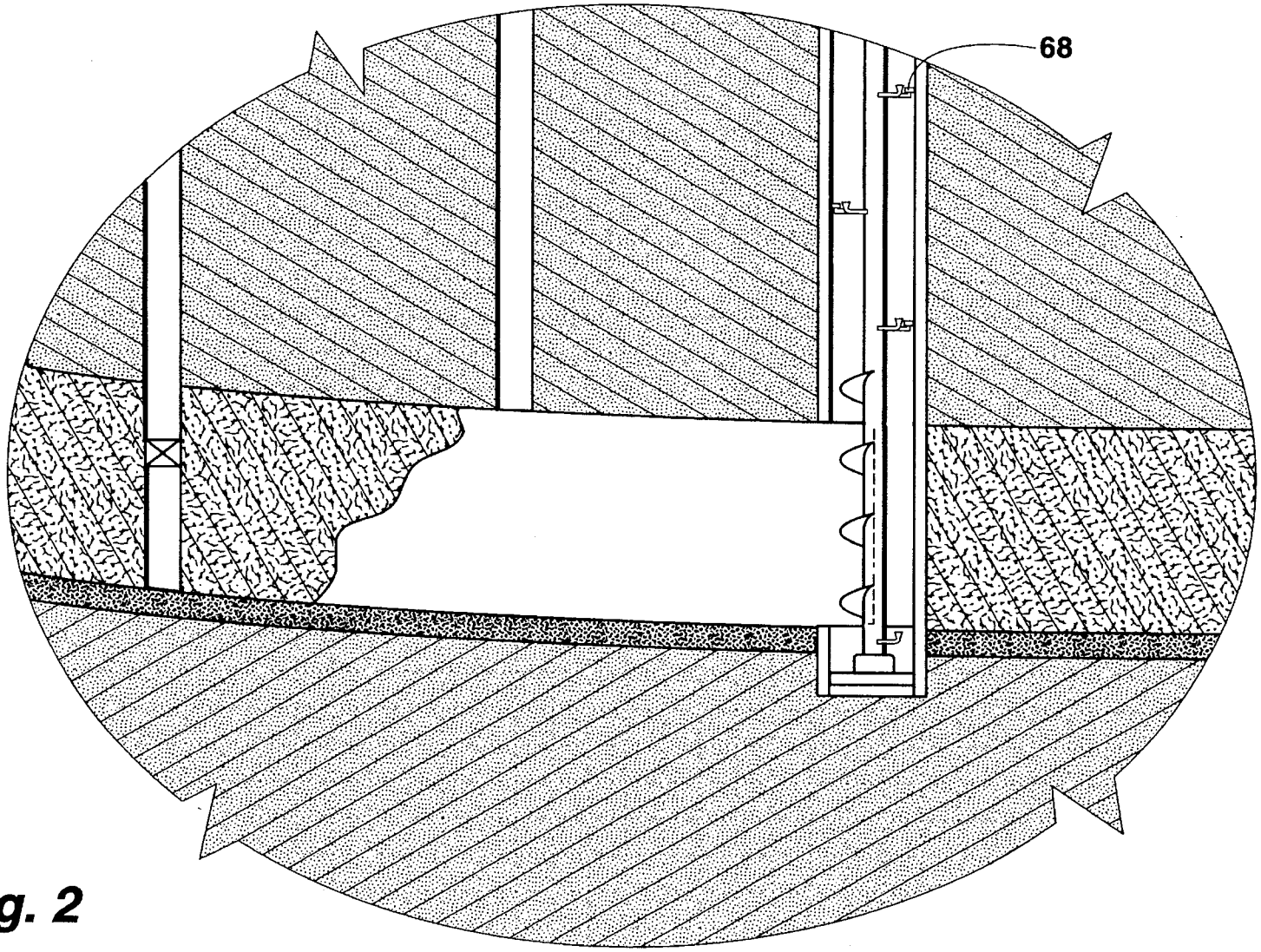
FIG. 2 is an enlarged partial view taken at 2 of FIG. 1 showing a bottom hole tool in place and showing the method of removing mainable material from the seam.
Figure 4:
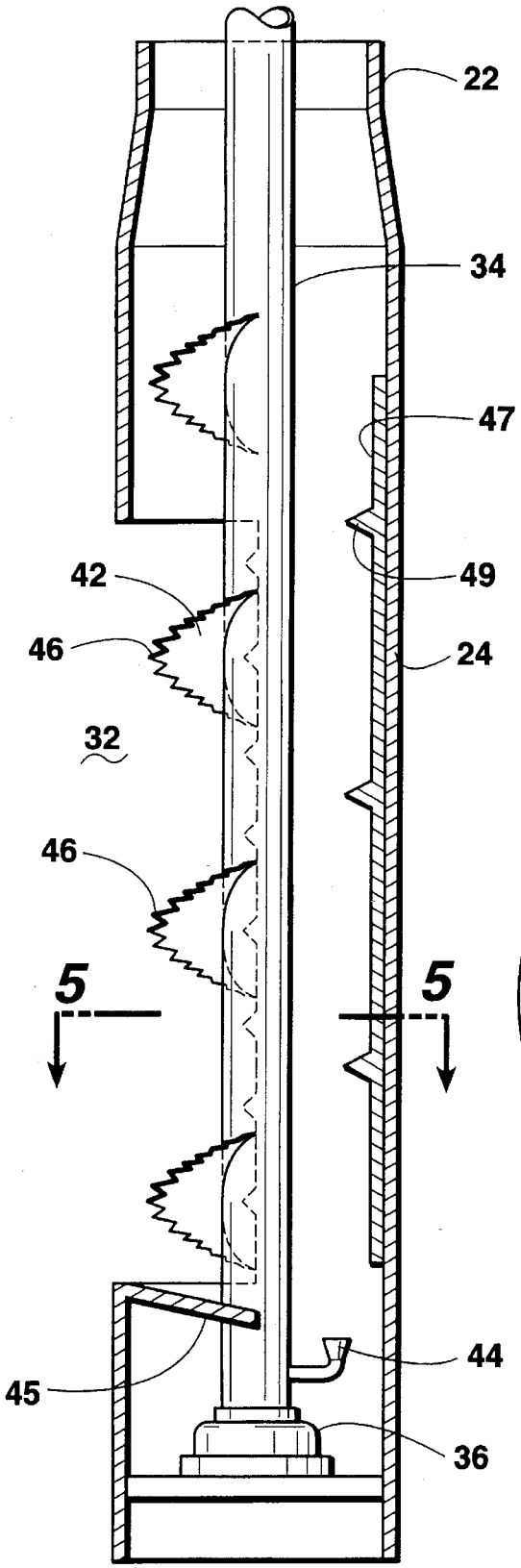
FIG. 4 is an enlarged elevational partially cross-sectional view of a bottom hole tool as employed in this invention.
Figure 5:
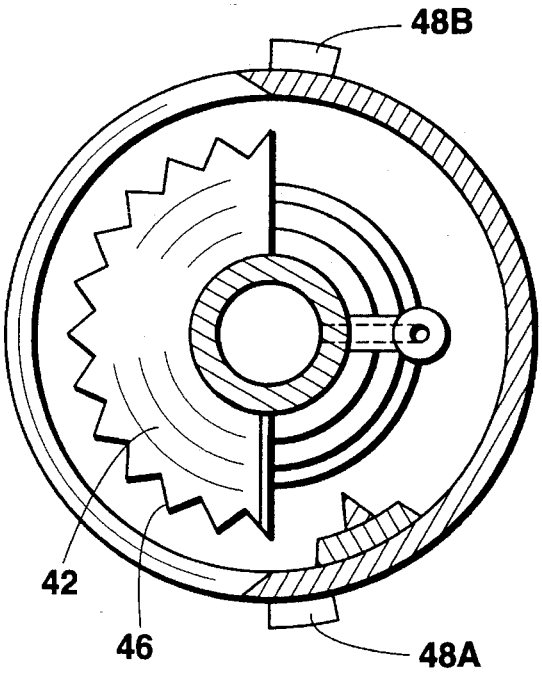
FIG. 5 is a cross-sectional view taken along the line 5—5 of FIG. 4.

Referring to FIGS. 2, 4 and 5, bottom hole tool 18 will be described.

Positioned within recovery hole 14 is large diameter casing 22. At the lower end of casing 22, as seen best in FIG. 4, is a tubular body 24 which must be larger than the diameter of casing 22. A special reducer coupling is employed to connect the segments.

Window 32 is in the form of a cut out of the wall of tubular body 24. The cut out should be approximately the height of seam 12.

Coaxially supported within tubular body 24 is a shaft 34. The shaft is supported by a lower bearing 36. The shaft 34 may be formed of a length of pipe, such as 4 inch diameter pipe. The pipe is then attached to other sections of the diameter pipe the full length of the recovery hole. Formed on shaft 34 is an auger blade and in the preferred arrangement as illustrated, the auger is comprised of semicircular segments positioned such that viewed along the vertical axis of the auger, the segments overlap each other. The auger blade segments 42 have internally formed teeth 46 on the external peripheral edge.

Welded on the exterior of tubular body 24 are vertical reinforcing straps 48A and B. These reinforcing straps are welded to the vertical outside edge of window 32 and serve to resist deflection of the tubular body and extend into the subsoil below coal seam for anchoring.

Welded to the interior of the bottom hole tool casing is a reinforcing bar 47 shaped conformably the interior of said casing, to which are mounted conical shaped steel protrusions 49 which act to help break up any larger pieces of coal or other ore.

Figure 3:
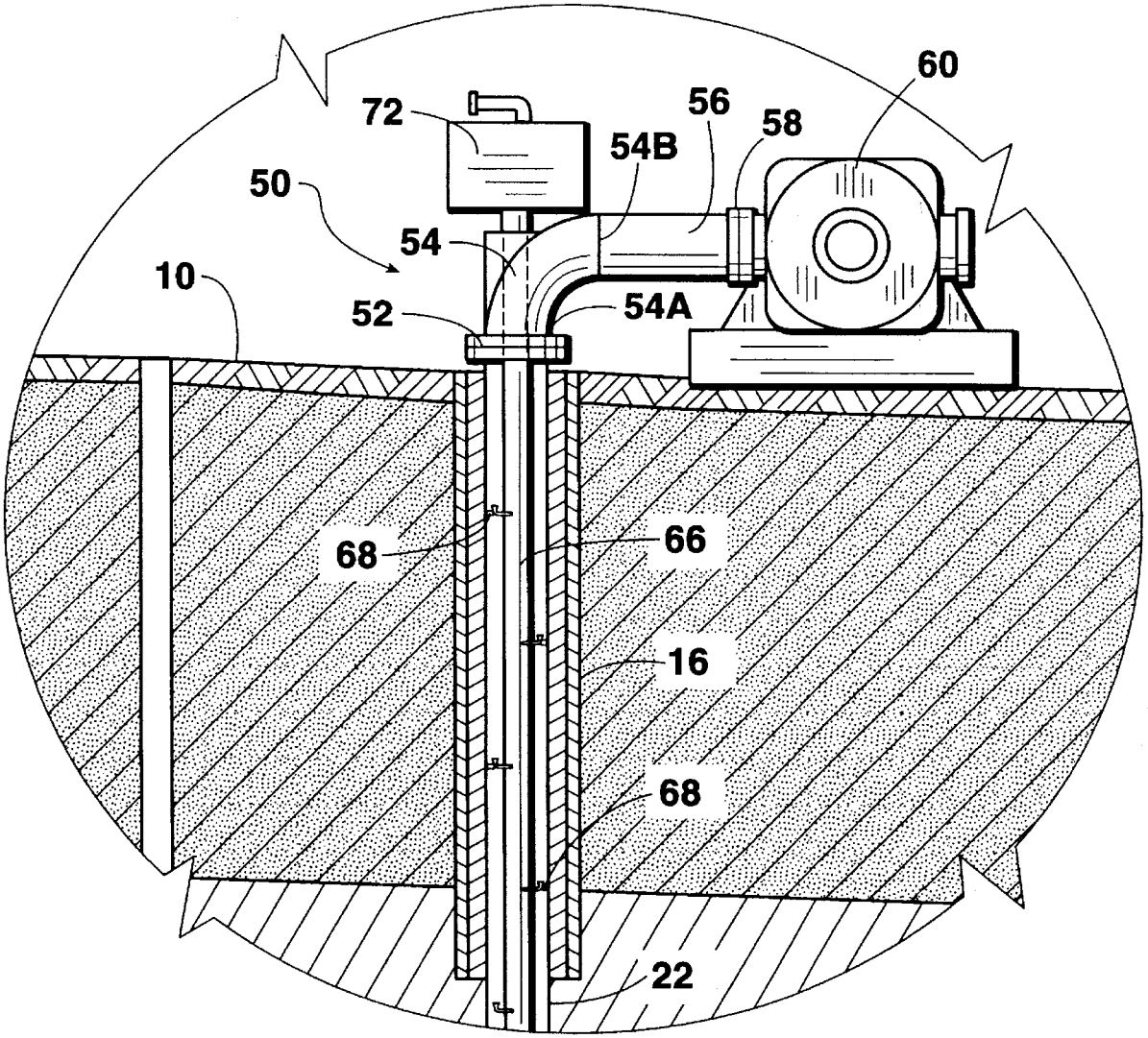
FIG. 3 is an enlarged partial view taken at 3 of FIG. 1 showing, in elevational view, some of the surface equipment as utilized in practicing the method of this invention.
Figure 8:
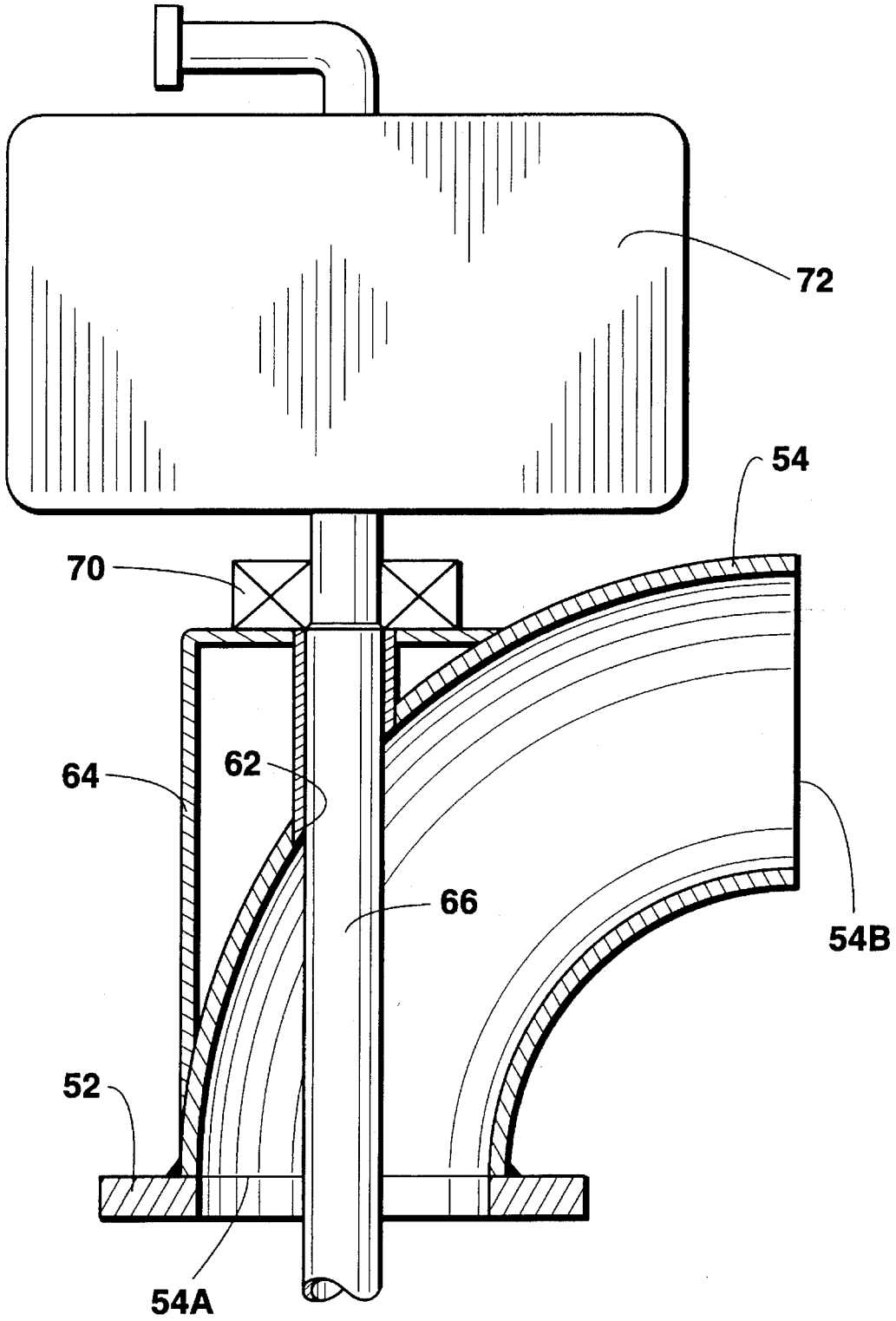
FIG. 8 is an enlarged cross-sectional view of the discharge head tool as used in the method of this invention.

Referring to FIGS. 3 and 8 details of a discharge head tool, generally indicated by the numeral 50, are shown. Casing 22 extends upwardly through the surface pipe 16. Above the earth's surface 10 a flange 52 is affixed to the casing. Attached to flange 52 is a tubular elbow member 54, the first end 54A thereof being attached to the flange and the elbow member having a second end 54B that is connected to a short length of pipe 56. The intake 58 of a dredge pump 60 is secured to the other end of pipe 56.

Tubular elbow member 54 has an opening 62 that communicates with a housing 64 affixed to the exterior of the elbow member.

Positioned within casing 22 is a vertical shaft 66 through which water under pressure is piped and to which are mounted nozzles 68 spaced axially and radially. The nozzles extend from one directly above the bottom bearing in the bottom hole tool and thence along the shaft to adjacent the earth's surface. As shown in FIG. 8 shaft 66 extends through opening 62 and through the opening in housing 64 and receives a sealed bearing 70. The shaft is then attached to a hydraulic driven speed reducer, which is illustrated emblematical at 72. By power supplied by speed reducer 72, shaft 66 and thereby nozzles 68, attached to it are rotated. In addition, the lower end of shaft 66 is affixed to the bottom hole tool shaft 34 to thereby also rotate auger blades 42.

Figure 7:
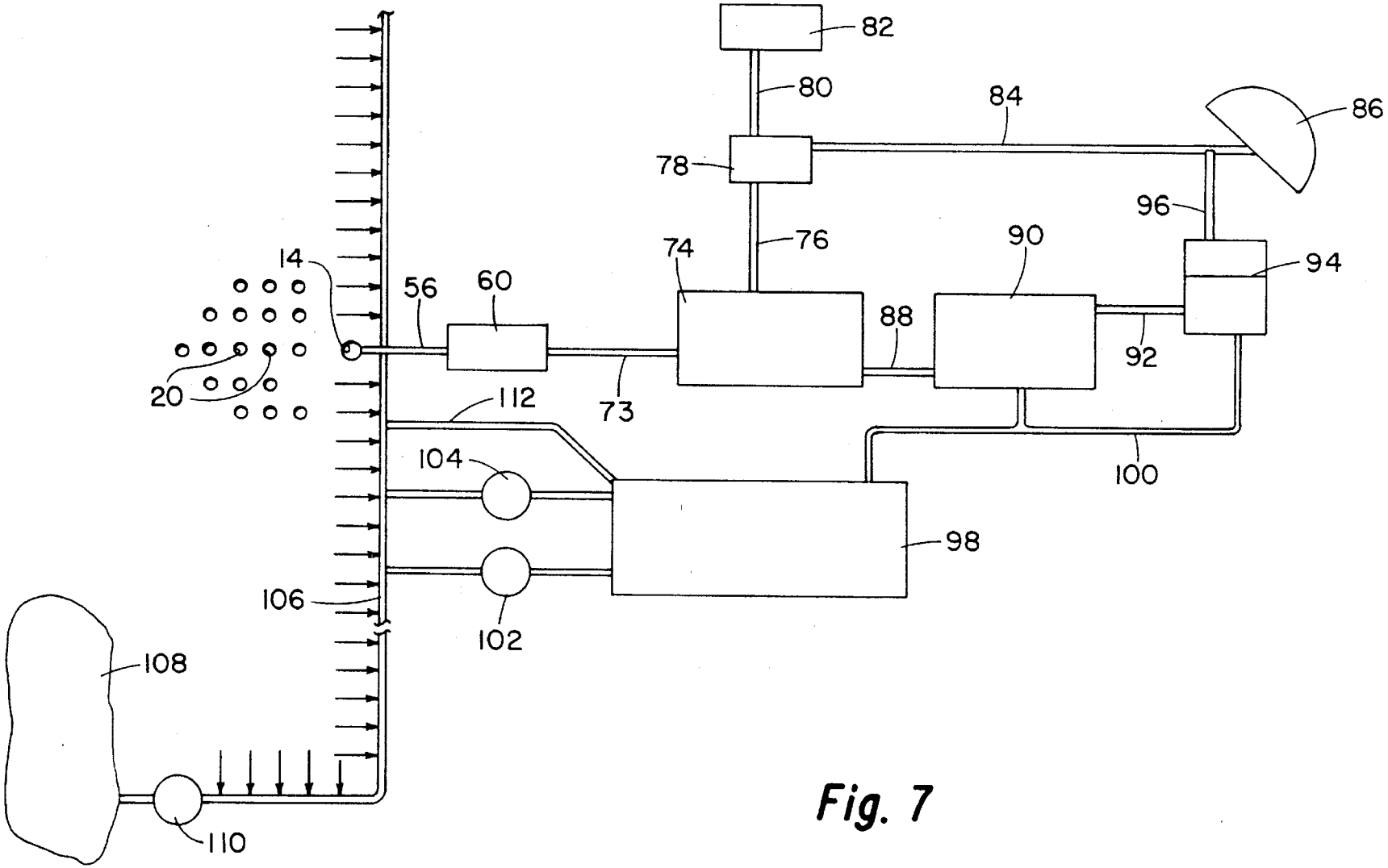
FIG. 7 is a plan view of a system for practicing the method of this invention showing diagrammatically the layout of a field to be mined and the equipment located at the earth's surface for conducting the mining operation.

A plan view for a basic system for practicing the invention is shown in FIG. 7. The recovery hole is indicated at 14 and a plurality of injection holes 20 are shown. Pipe 56 extending from the recovery hole connects to dredge pump 60 as previously described. From dredge pump 60 a slurry line 73 connects to a shaker 74 for separating fragmented coal from a slurry. The coal passes by way of conveyor 76 to a rotator breaker 78. Rock separated by the rotator breaker is fed by a conveyor 80 to a rock storage refuge 82. The separated coal is fed by conveyor 84 to a stacker 86. In addition, from shaker 74 a slurry line 88 feeds to a washing plant 90 where the separated coal is washed. By conveyor 92, coal is fed to a de-watering; screen and drier 94. From drier 94 the recovered coal is fed by conveyor 96 to stacker 86.

A water tank 98 provides a water reservoir. Drainage from the washing plant and dewatering screen are fed by conduits 100 into the watering tank. From the watering tank pumps 102 and 104 supply a distribution pipe 106 that has facilities for connection of water to the input of the injection holes, as well as for the nozzles in the recovery hole.

A source of water 108 which can be a well, a lake, a river, or the like, is used to provide water for the mining operation. Pump 110 connects water to the distribution pipe 106 and can be used to fill tank 98 by way of water supply 112.

The plant lay out of FIG. 7 is representative of means of equipment used for practicing the invention.

Figure 6:
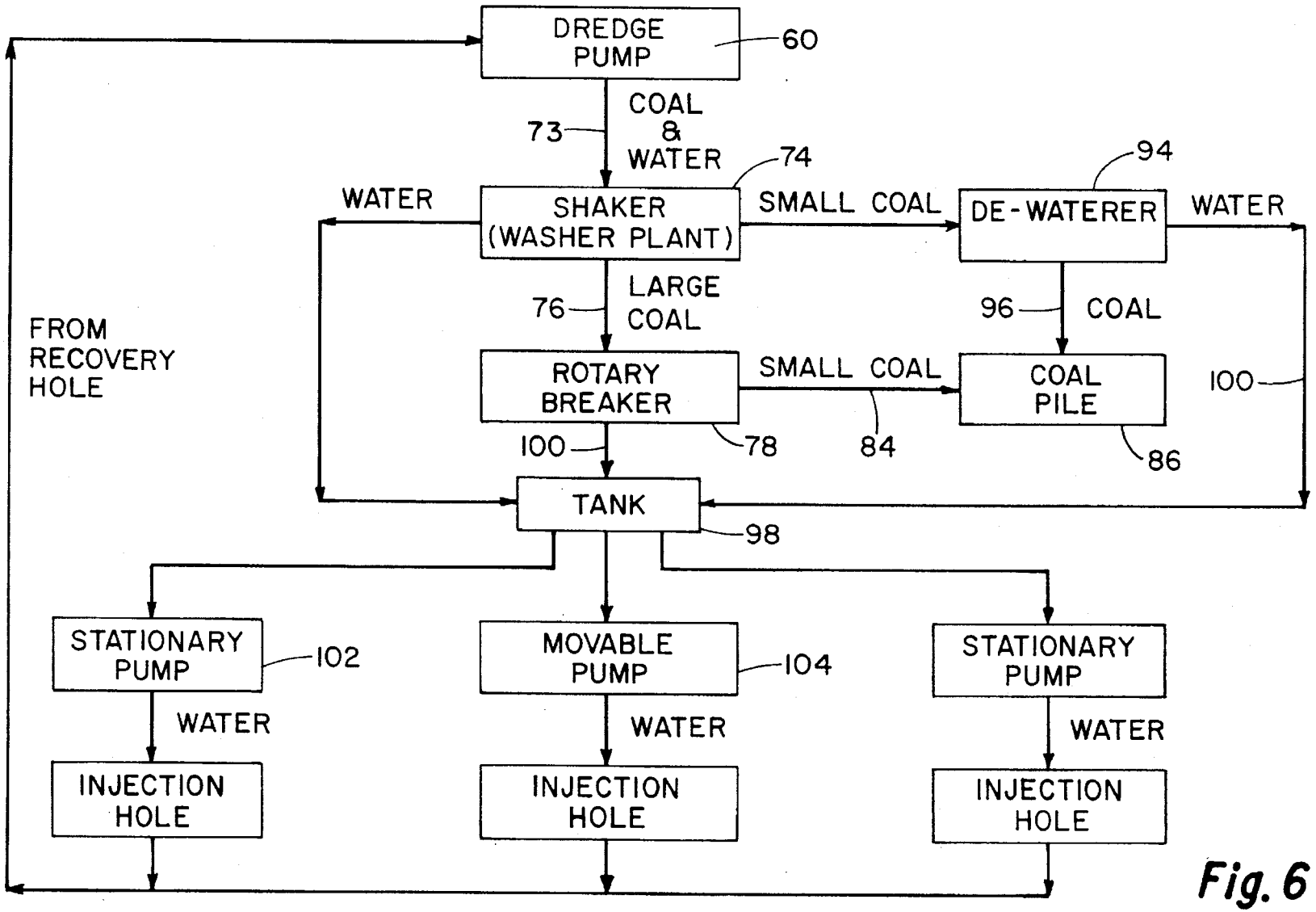
FIG. 6 is a diagram showing the flow of water as used in the mining method for removing a minable product from an underground seam.

FIG. 6 is a flow diagram of water as employed in the system. All water is recycled and the only water loss, as will be described subsequently, is that which is used to fill the seam as coal is removed.

The physical apparatuses and system for employing the method of the invention having been described, the basic method will now be set forth. First, a large hole is drilled for a relatively short depth and a surface pipe 16 is set in the hole. Then a recovery hole 14 is drilled through the surface pipe and extends to just below coal seam 12. The equipment of FIGS. 2, 4 and 5 are installed in the recovery hole 14 in the arrangement previously described, that is, the bottom hole tool 18 is installed with the connecting casing and the surface equipment is installed at the recovery hole as shown in FIG. 3.

Injection holes are drilled adjacent the recovery hole and typically spaced, such as about five feet, from the recovery hole. While recovery hole 14 is preferably drilled substantially vertically, the injection holes are preferably drilled to intercept seam 12 perpendicularly thereof. Explosives are placed in the injection holes and detonated to fracture coal from the coal seam. Water is then injected into the injection holes to move the fractured coal to bottom hole tool 18.

FIG. 1 shows the system after the first injection holes nearest the recovery hole have been detonated, providing a clear area 114. The fragmented coal in the space between the point of detonation and the recovery hole is moved in the direction toward the recovery hole by the flow of water. After detonation, water is injected into all or a portion of the injection holes to move the fragmented coal to the bottom hole tool 18. At bottom hole tool 18 the coal is carried through open window 32 to contact auger blades 42. Water under pressure ejected by the bottom nozzle 44, helps to move the coal upwardly into the interior of the bottom hole tool 24 and further upwardly into the interior of the casing 22 are thence to the surface. The bottom flange 45, provides a buffer to keep the bottom water nozzle 44 from ejecting the coal out of the window of the bottom hole tool. Any fragments of coal that are too large to be carried upwardly by the auger are severed and further fractured by auger blades 42 having teeth 46 thereon to break up the coal and further by the crushing bar 47. The hydraulic pressure within the system as well as the rotating auger, the rotating water nozzles in the recovery hole all help to move the coal and slurry to the earth's surface.

As the drilling operation proceeds the injection holes, which are used for the placement of explosives and then subsequently used for the injection of water, are sealed as further injection holes are employed since water must be injected at the farthest point from the recovery well where fragmented coal exists. Closure or plugging of the injection holes 20 can be accomplished utilizing an inflatable plugging tool.

The method of this disclosure is preferably practiced in a coal seam that is not horizontal but which has an up slope. The recovery hole 14 is positioned at the lowest point in the field to be mined and injection holes are drilled in patterns from the recovery hole 14 up slope of coal seam 12. In this way, water injected into the coal seam to move fragmented coal always moves the coal downwardly in the direction toward the recovery hole.

A single recovery hole may be employed with a large number of injection holes so that a single recovery hole can be used to mine a relatively large acreage. Naturally, as the fragmented coal must be moved at greater distances from the place where it is fragmented from the coal seam by an explosion to the recovery well, the efficiency of movement begins to decrease.

After a field has been mined to the extent commercially feasible utilizing a recovery hole, a new recovery hole is drilled and the entire procedure repeated.

When the use of the injection and recovery holes has been completed, they are plugged so as to prevent contamination of water supplies. In addition, after a field has been mined utilizing the techniques herein explosives can be set off in the injection holes above the coal seam to blast rock loose to fall in and fill the evacuated coal seam.

When the entire drilling procedure is completed, all equipment can be removed and the surface of the earth is left substantially undisturbed. All of the recovery holes and injection holes are plugged and pipe removed well below plow depth so that almost no environmental damage is caused by the mining procedures of this system.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A bottom hole tool for removing fractured minable product from an underground seam, in which the seam is penetrated by a hole drilled substantially vertically from the earth's surface, comprising:

an upright tubular body having a tubular axis, having a top end and a bottom end and having a tubular wall, the wall having an elongated vertical opening therein of width less than substantially one-half of the circumference of the tubular wall;

an auger positioned in said tubular body, the auger having an axis of rotation that is substantially coincident with the tubular axis of said body and of diameter less than the internal diameter of said tubular body, the auger having a top end and a bottom end, the length of the auger being at least the length of said tubular body opening; said auger having blade segments extending only one-half way around the circumference of the central shaft and positioned in such a way as to be on top of each other when observed from the tubular axis of said auger, said auger blades positioned from the bottom end to the top end;

a hollow central shaft through which water may be injected;

a nozzle with one end attached to the central shaft and the other end radially outward and pointing upwards toward the top end of the auger, such that water injected down the hollow central shaft would be ejected upward by means of the nozzle, said nozzle located above the bottom of said tubular body but below said lowest auger blade segment, said nozzle being rotatable within the bottom hole tool as the auger is rotated;

a flange attached to the bottom edge of the elongated vertical opening, said flange extending inwardly and downward from the opening to within a close proximity of the central shaft outer diameter means to rotate said auger;

a crushing bar conformably attached to the inside wall of said tubular body opposite said vertical opening, said crushing bar having protrusions mounted thereunto spaced vertically along said bar, between the rotating auger segments;

means to attach said tubular body top end to conduit means extending from the earth's surface; and means to rotate said auger.

2. A bottom hole tool according to claim 1 including:

bearing means rotatably supporting said auger bottom end to said tubular body adjacent said bottom end thereof.

3. A bottom hole tool according to claim 1 wherein said means to rotate said auger includes;

a rotatable shaft means extending from the earth's surface having a lower end attached to said auger upper end in co-axial arrangement.

4. A bottom hole tool according to claim 3 wherein said rotatable shaft means comprises a hollow shaft with means to inject water down said hollow shaft and with nozzle means mounted radially outward from said hollow shaft means spaced at intervals along the length of the shaft from said bottom hole tool to the surface of the earth, said nozzle opening pointing upwards towards the surface and rotating within the hole as the rotatable shaft is rotated.

5. A bottom hole tool according to claim 1 wherein said auger includes a spiraled blade having a spiraled edge and wherein said spiraled edge is at least in part of saw tooth configuration.

6. A method of removing a minable product, such as coal, from an underground seam of minable product, such as a coal seam, comprising the steps of:

drilling a substantially vertical recovery hole from the earth's surface through a seam of minable product;

installing in the recovery hole a bottom hole tool;

installing casing pipe in said recovery hole;

said bottom hole tool having an elongated opening of substantially one-half the circumference of said tool, the opening positioned toward the ore seam, said bottom hole tool being equipped with an auger device and a means for supporting said auger device and rotating same;

said means of rotating said auger comprising a hollow pipe with connections from said bottom hole tool to the earth's surface;

nozzles mounted radially outward from said hollow pipe spaced along the length of said pipe from the bottom of the bottom hole tool below the auger blades along the pipe to the surface, said nozzles forcing water up the recovery hole;

drilling a plurality of closely spaced-apart injection holes from the earth's surface through the seam of minable product, the injection holes being drilled in a pattern extending from said recovery hole;

inserting an explosive in said seam of minable product where penetrated by each of said injection holes;

sequentially igniting the explosive in each of the injection holes to blast fractured minable material from said seam;

injecting water sequentially in said injection holes to move fractured minable material toward said recovery hole;

operating the recovery hole auger and injecting water down the central hollow pipe and upward through the nozzles to raise said fractured minable product to the earth's surface.

* * * * *